US006170813B1

(12) United States Patent
Bowers

(10) Patent No.: US 6,170,813 B1
(45) Date of Patent: Jan. 9, 2001

(54) VISE WITH ADJUSTABLE JAW INSERTS

(76) Inventor: Jerald A. Bowers, 46613 Barbara Dr., Macomb Township, MI (US) 48044

( * ) Notice: Under 35 U.S.C. 154(b), the term of this patent shall be extended for 0 days.

(21) Appl. No.: 09/358,231

(22) Filed: Jul. 21, 1999

(51) Int. Cl.[7] ..... B25B 1/24
(52) U.S. Cl. ..... 269/282; 269/283
(58) Field of Search ..... 269/282, 283, 269/296, 277

(56) References Cited

U.S. PATENT DOCUMENTS

| | | | | |
|---|---|---|---|---|
| 530,733 | * | 12/1894 | Tower | 269/283 |
| 2,480,415 | * | 8/1949 | Mettler | 269/283 |
| 2,770,156 | * | 11/1956 | Brettrager | 269/283 |
| 3,403,901 | * | 10/1968 | Servadio | 269/284 |
| 4,078,782 | | 3/1978 | Carlson . | |
| 4,251,066 | | 2/1981 | Bowling . | |
| 4,437,654 | | 3/1984 | Chiapetti . | |
| 4,558,856 | * | 12/1985 | Shaffer | 269/277 |
| 4,602,772 | | 7/1986 | Wight et al. . | |
| 4,798,371 | * | 1/1989 | Wallisser | 269/284 |
| 5,419,540 | * | 5/1995 | Teafatiller | 269/283 |

* cited by examiner

*Primary Examiner*—Robert C. Watson
(74) *Attorney, Agent, or Firm*—Harness, Dickey & Pierce, P.L.C.

(57) ABSTRACT

The present invention relates to a vise for holding a workpiece. The vise includes a base supporting a moveable jaw, a fixed jaw, and a mechanism for moving the moveable jaw toward the fixed jaw. Each jaw includes a working surface, the working surfaces being disposed in facing relation and including at least two slots formed vertically spaced apart. Each slot is horizontally aligned with a slot in the opposing working surface. A selected pair of horizontally aligned slots each receive an insert for positioning the workpiece a distance from the base of the vise. The user's selection of the pair of horizontally aligned slots for reception of the inserts determines the position of the workpiece relative the base.

22 Claims, 4 Drawing Sheets

VISE WITH ADJUSTABLE JAW INSERTS

BACKGROUND OF THE INVENTION

The present invention relates to vises for holding workpieces, and more particularly, to a vise having adjustable jaw inserts for holding workpieces of varying dimensions.

Prior vise designs include replaceable jaws for accommodating different types of workpieces. For example, U.S. Pat. Nos. 4,062,772 and 4,437,654 both describe a replaceable vise jaw for accommodating a particular application, including the size and material of a particular workpiece. The vise described by U.S. Pat. No. 4,251,066 includes jaws releasably attached via dovetails formed on the vise for accommodating a particular workpiece for a vertical milling machine. Further, the vise of U.S. Pat. No. 4,078,782 includes accessory jaws for expanding the range of the vise.

In each of these vises, the replacement of the jaws themselves, or attachment of a supplemental jaw to the jaws of the vise, is considered to be a cumbersome method for accommodating a particular workpiece.

The vise of the present invention overcomes the disadvantages associated with prior art vises by providing a simple adjustment apparatus for accommodating a workpiece without replacement of the vise jaws themselves.

SUMMARY OF THE INVENTION

The advantages of the present invention are accomplished by an improved vise having a series of particularly positioned apertures or slots formed in opposing faces of the respective jaws. Each series of spaced apertures or slots receives one of a pair of inserts defining the depth of the area between the jaws, the inserts generally being disposed in a horizontally opposed pair of slots such that the inserts maintain the workpiece in a horizontally aligned position. By selecting the desired apertures or slots on each jaw face and inserting therein a pair of inserts defining the desired elevation, a workpiece placed between the opposing faces of the vise jaws is blocked against movement by the inserts. Accordingly, the user can define the desired elevation for a particular workpiece, and can vary that elevation simply by replacing or moving a pair of vise jaw inserts in horizontally opposed slots or apertures.

Under an alternative embodiment of the present invention an improved vise having a single aperture or slot formed in each of the opposing jaw faces is disclosed. Each aperture or slot receives one of several pairs of inserts defining the depth of the area between the jaws. The inserts vary in height to define a surface for supporting a workpiece at a user-selected elevation. Accordingly, by selecting the appropriate pair of inserts, the user can define the desired height of the supporting surface for a particular workpiece, and can vary that height simply by replacing the selected pair of inserts with a different pair of inserts.

Additional objects, advantages, and features of the present invention will become apparent from the following description and appended claims, taken in conjunction with the accompanying drawings.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
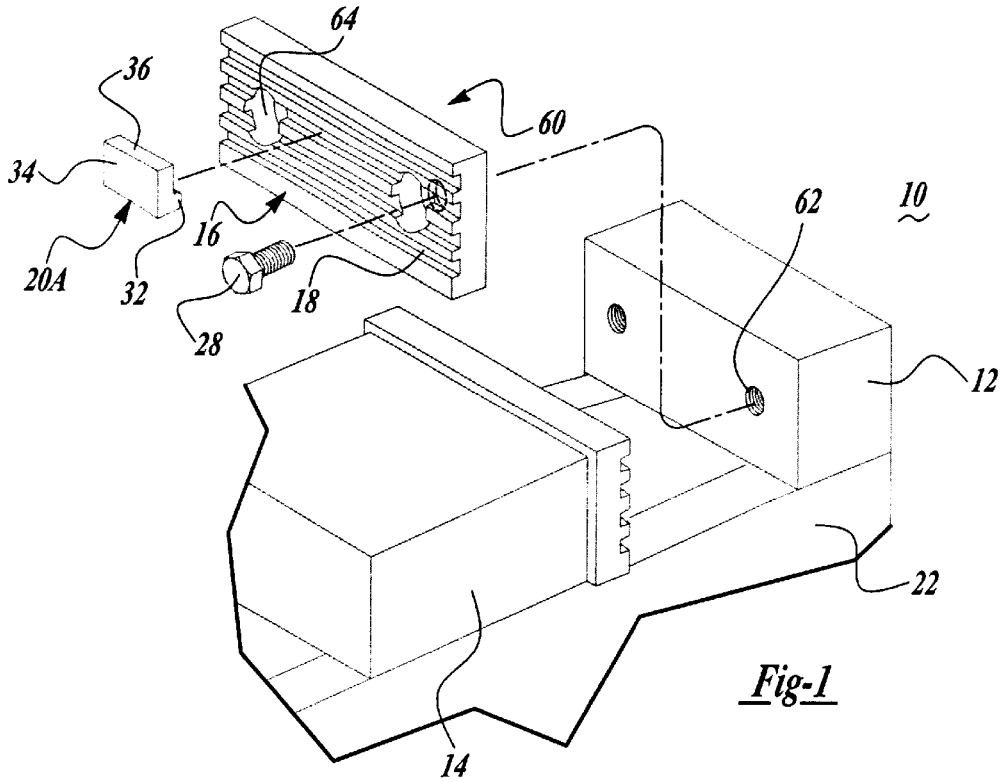
FIG. 1 is a partial perspective view of a vise with adjustable jaw inserts according to the invention.
Figure 1A:
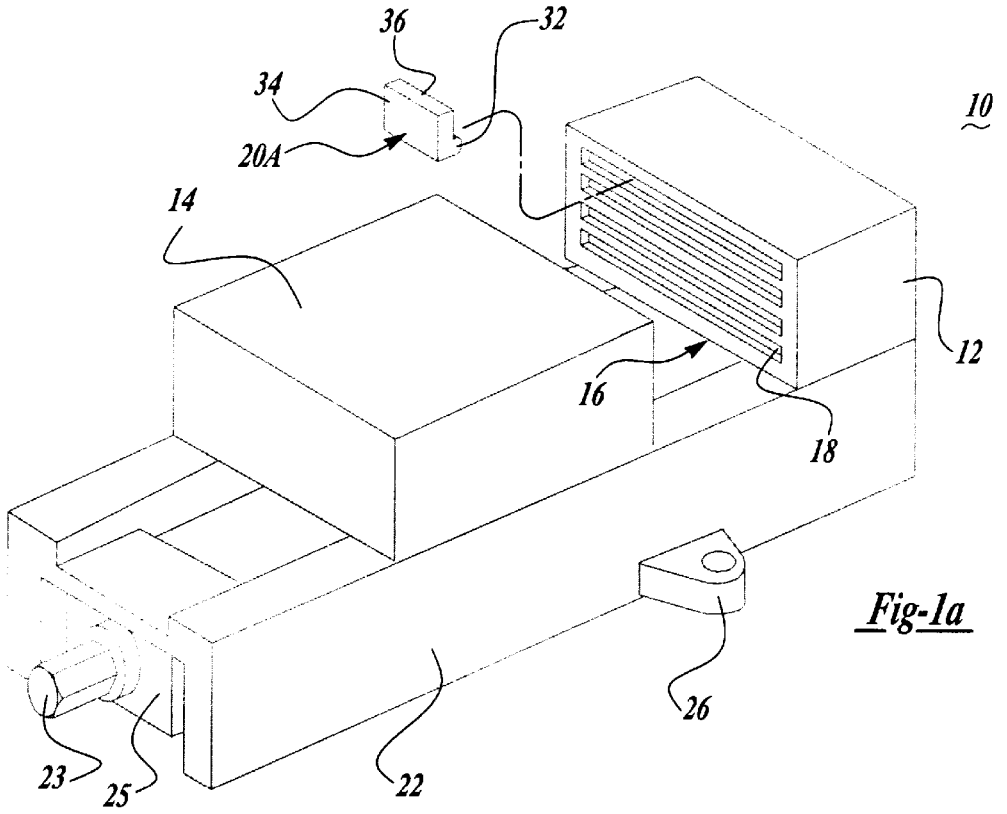
FIG. 1*a* is a perspective view of another embodiment of a vise with adjustable jaw inserts according to the invention.

Referring to the drawings, and to FIGS. 1 and 1*a* in particular, a vise 10 is shown including a fixed jaw 12 and a moveable jaw 14. The fixed and moveable jaws 12, 14 each include a working surface 16 having a series of spaced apertures or slots 18 formed therein. For simplicity, the term slot will be used hereinafter and should be interpreted as encompassing apertures as well. Each working surface 16 is formed integral to jaws 12 and 14 in FIG. 1*a*, but are removable attachments 60 in FIG. 1. The working surfaces 16 grip and hold a workpiece 50 held between the jaws 12, 14 of the vise 10. The slots 18 removably receive inserts 20 for supporting the workpiece 50 as will be described in greater detail below. Working surfaces 16 may have scoring thereon to grip the workpiece more securely, or may have a surface finish or material composition for securing a workpiece 50 that is easily scratched or damaged. For example, working surfaces 16 can be metallic or elastomeric material, or could be a metallic body faced with elastomeric material, such as plastic or rubber, to safely retain delicate workpieces.

The vise 10 further includes an elongated base 22 mounting the fixed jaw 12 and moveable jaw 14. The moveable jaw 14 is slidably mounted on top of the base 22 for movement toward and away from the fixed jaw 12 by means of a lead screw 23 mounted on a flange 25 on an end of the base 22 opposite the jaw 12. The base 22 includes bolt lugs 26 through which the base 22 may be fastened to a workbench (not shown).

The slots 18 are formed in the opposed working surfaces 16 of jaws 12, 14. Preferably, the slots 18, as shown in FIGS. 1 and 1*a*, are equidistantly spaced and horizontally disposed along each working surface 16. Further the slots 18 are disposed vertically co-planar with a respective slot on each opposed working surface 16 of the fixed and moveable jaws 12, 14. The slots 18 are preferably rectangular in cross-section and uniform along their respective lengths and widths, but may also be formed of other cross-sectional shapes as discussed below. Further, while the slots 18 are shown to extend the width of working surfaces 16 in FIG. 1, shorter slots extending only partially along the working surfaces 16 can be used, as shown in FIG. 1*a*.

Figure 4:
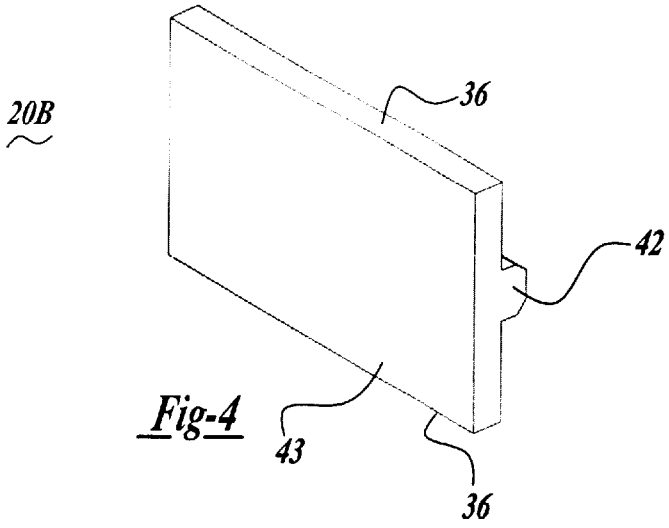
FIG. 4 is a perspective view of an insert for a vise with adjustable jaw inserts according to the invention.
Figure 5:
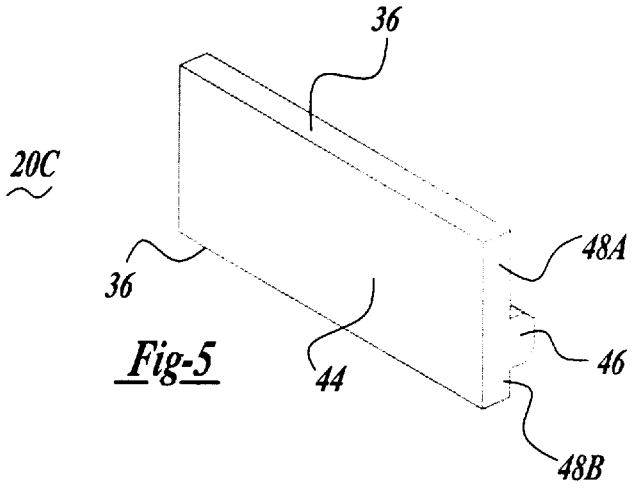
FIG. 5 is a perspective view of another insert for a vise with adjustable jaw inserts according to the invention.

A variety of inserts 20 are shown in the drawings. For example, in FIGS. 1 and 1*a*, insert 20A is a substantially L-shaped member with an anchoring finger 32 received within a slot 18 and a supporting member 34 defining a supporting surface 36. Also, an insert 20B, as shown in FIG. 4, is a substantially T-shaped member formed of a supporting member 43 and a centrally and perpendicularly disposed anchoring finger 42, with the anchoring finger 42 selectably received within a slot 18 and the supporting member 43 defining a horizontal supporting surface 36 at each end. Further, insert 20C, as shown in FIG. 5, is also T-shaped, with a perpendicularly disposed anchoring finger 46 attached to a supporting member 44, but offset centrally therefrom. The offset attachment of finger 46 to member 44 defines different length supporting arms 48A and 48B, as measured vertically from anchoring finger 46, comprising the supporting member 44. By using different length arms 48A and 48B, simply turning an insert 20C upside down provides a supporting surface 36 with a different height relative anchoring finger 46. As should be understood by those skilled in the art, various shapes and dimensions can be used, with the object being to provide a surface 36 for supporting a workpiece. Further, while the supporting surface 36 is shown having a particular width for each insert 20 described previously, the dimensions can be larger or smaller depending on the workpiece 50 to be supported.

Figure 9:
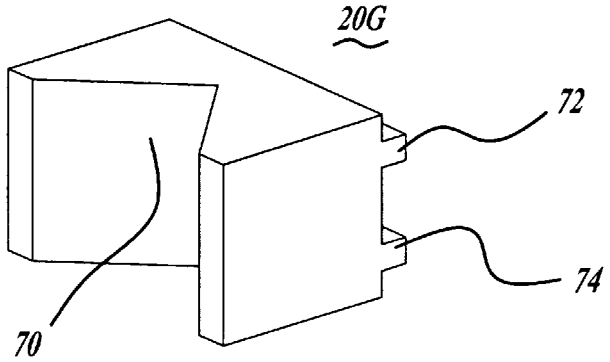
FIG. 9 is a perspective view of another insert for a vise with adjustable jaw inserts according to the invention.

Another type of insert is shown in FIG. 9, where an insert 20G is illustrated to include a wedge-shaped face 70 and a pair of anchoring fingers 72, 74 spaced apart vertically from each other. The face 70 is particularly useful for holding cylindrical or tubular workpieces, and may be useful for holding other irregularly shaped workpieces. Other shapes for face 70, such as an arcuate surface, may be used to accommodate other irregularly shaped workpieces. While a single anchoring finger can be used for insert 20G, as demonstrated for prior versions of inserts 20, the pair of anchoring fingers 72, 74 are useful where a more secure attachment to working surface 16 is needed, or where the insert supports substantial weight. For any of the inserts 20 described herein, one or more anchoring fingers can be used to attach the insert 20 to working surface 16.

Figure 2:
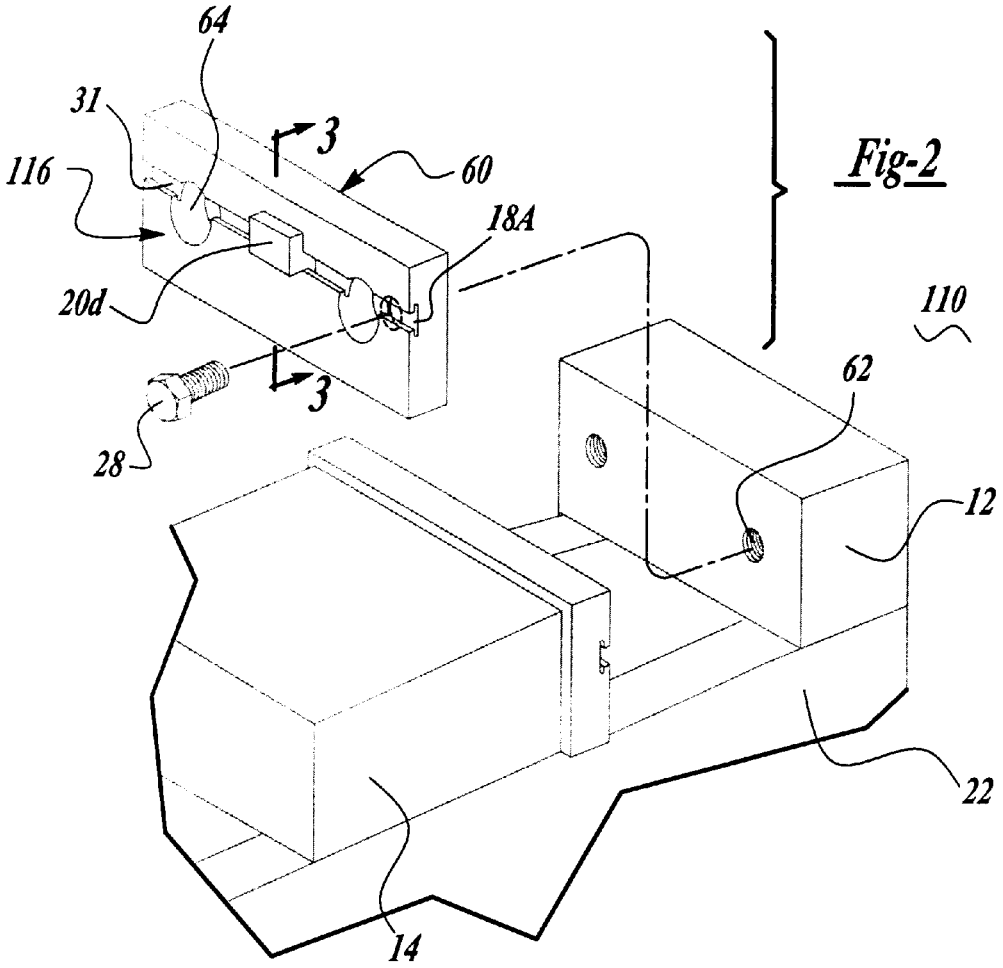
FIG. 2 is a partial perspective view of a further embodiment of a vise with adjustable jaw inserts according to the invention.
Figure 3:
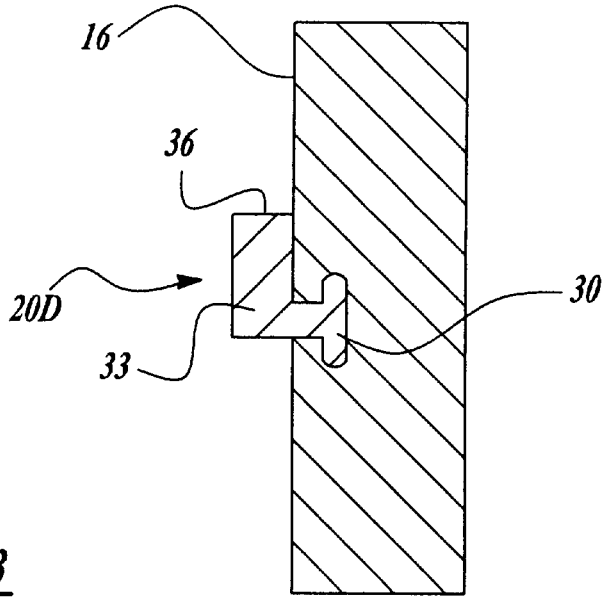
FIG. 3 is a side sectional view of an attachment along lines 3—3 of FIG. 2.

The slots 18 can also vary in dimension. While the preferred dimension is the generally rectangular cross-section slot as shown in FIGS. 1 and 1*a*, an alternative cross-section for the slots 18 is shown in FIGS. 2 and 3, wherein slot 18A is generally elliptical in cross-section. An insert 20D has a supporting member 33 and an anchoring finger 30, which has an end with a cross-section similar to that of the slot itself, whereby the insert 20D is slid into place from an open end 31 of each slot 18A. The L-shaped insert 20D could similarly be T-shaped as discussed above. The anchoring finger need not be identical in cross-sectional shape, but could, for example, only include a complementary-shaped upper portion for hooking into an uppermost portion of the slot, whereby the inserts 20 need not be slid into place from an open end 31 but could be tilted and locked into place from an intermediate position along each slot 18.

Figure 6:
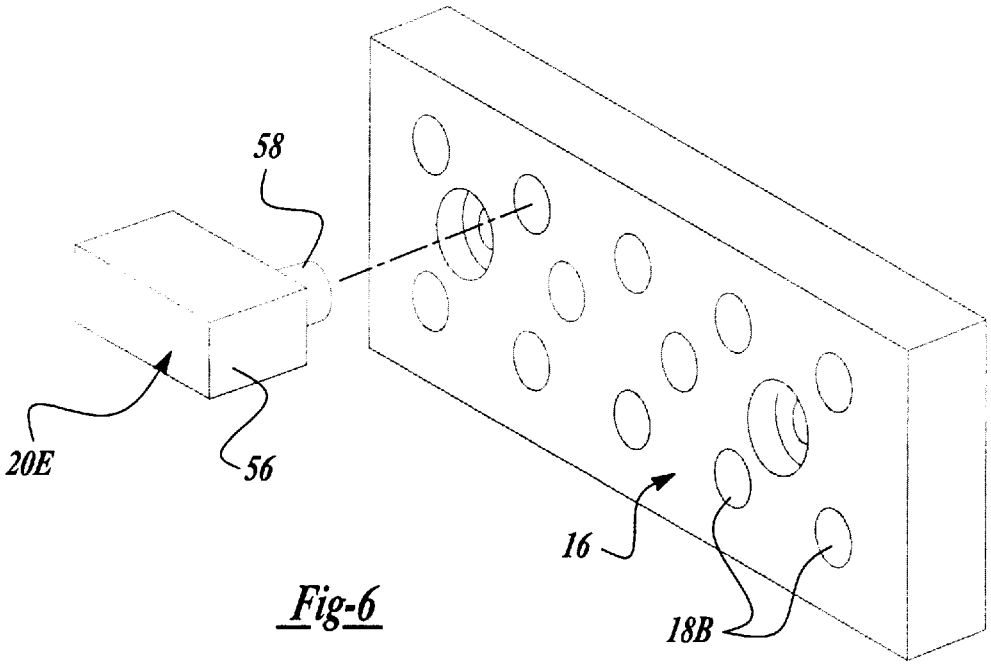
FIG. 6 is a perspective view of an attachment for a vise with adjustable jaw inserts according to the invention.

Additionally, the slots 18 can be in the form of a plurality of apertures 18B arranged in a suitable matrix as best illustrated in FIG. 6. An insert 20E includes a block-like supporting member 56 attached to an extending tubular anchoring finger 58 shaped complementary to apertures 18B. A user selects the horizontal and vertical position for supporting the workpiece 50 by inserting the insert 20E in one of the matrix of apertures 18B.

According to embodiments illustrated in FIGS. 1, 1*a*, 7 and 8, the anchoring finger of the insert 20 is dimensioned to be press fit into a slot 18 anywhere along its length. To accommodate the press fit, distal end of the anchoring finger is preferably tapered, as illustrated best for anchoring fingers 42, 46 in FIGS. 4 and 5, respectively. Thus, the inserts are placed into slots 18 opposing each other on opposite working surfaces 16 of the fixed jaw 12 and moveable jaw 14. For the embodiments of FIGS. 1, 1*a* and 7, the inserts 20A can be positioned in any of the four horizontally opposed slots formed in the opposed working surfaces 16 of the respective jaws 12, 14. Once inserted, the supporting surfaces 30 of the insert can support a workpiece 50 placed between the jaws 12, 14. As mentioned above, the slots 18 in each face are aligned so that the supporting surfaces 30 of each insert 20 are aligned vertically when the inserts 20 are placed in a pair of horizontally opposed slots 18. While a series of four slots 18 are shown horizontally aligned on each working surface 16, as few as two and as many as ten or more slots may be provided, depending of course on the desired application. Also, opposed slots 18 need not necessarily be horizontally aligned as long as the supporting surfaces 30 are horizontally aligned to support the workpiece 50.

Figure 7:
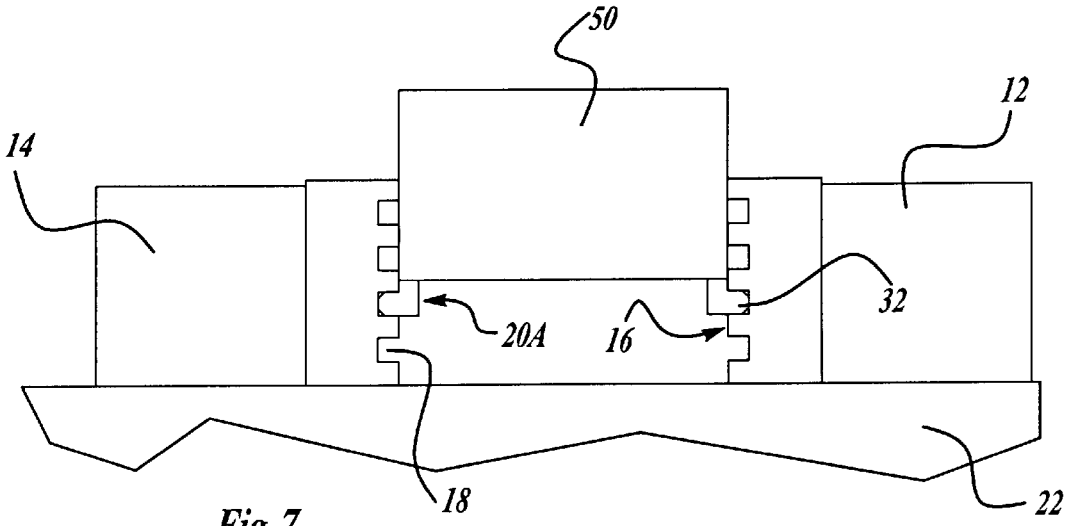
FIG. 7 is a partial end view of a vise with adjustable jaw inserts according to the invention supporting a workpiece.
Figure 8:
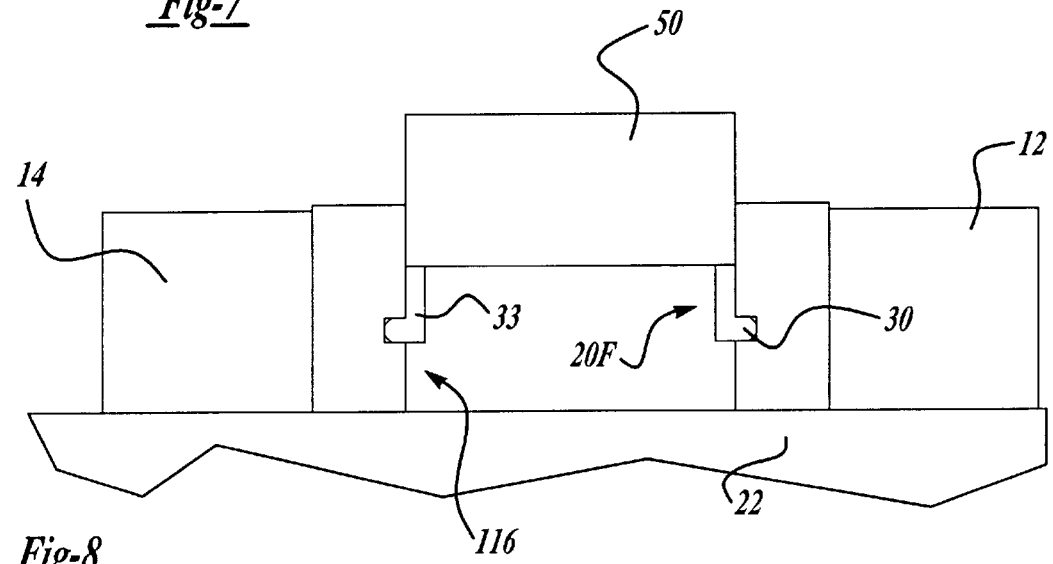
FIG. 8 is a partial end view of another vise with adjustable jaw inserts according to the invention supporting a workpiece.

As shown in FIGS. 7 and 8, a workpiece 50 has been inserted between the fixed jaw 12 and moveable jaw 14 of vise 10 according to the invention. Inserts 20 are placed in opposite slots 18 in order to support the workpiece 50 between the respective jaws 12, 14. As shown clamped, the jaws 12 and 14 compress the workpiece 50 by exerting a horizontal force on each side of the workpiece 50 while the inserts 20 block the workpiece from movement in the downward direction, whereby the workpiece 50 is held at the selected height.

To select the height in the variation of the invention shown in FIG. 7, the user of the vise 10 simply selects the pair of opposed slots 18 in the working surfaces 16 of the fixed jaw 12 and moveable jaw 14 in which to place the inserts 20. Once selected, and aligned horizontally, the workpiece 50 can be supported on the supporting surfaces 30 of each insert 20 after the jaws 12 and 14 have been placed proximate enough to support the workpiece 50 without compressing the workpiece 50. Once the workpiece is supported but not compressed, the moveable jaw 14 can be moved toward the fixed jaw 12 until opposed horizontal pressures are exerted on the workpiece, at which point the workpiece is held compressed at the selected height.

The vise 10, in addition to its ability to provide support for a workpiece 50 at a selected height, can also function as a typical vise 10 by simply not using the inserts 20. Then, by inserting the workpiece with the base 22 of the vise 10 blocking the workpiece against further downward movement, the moveable jaw 14 can be moved towards the fixed jaw 12 to clamp the workpiece in place. Thus, the vise 10 according to the invention provides the operator with the additional ability to support a workpiece at a desired height without eliminating the basic ability of the vise 10 to clamp a workpiece in place consistent with conventional use.

As should be understood from a review of the foregoing description, the present invention not only offers a vise that is selectively adjustable to support a workpiece at the desired height, but also offers a convenient way to adjust that height. Also, the vise 10 according to the invention functions as a conventional vise, whereby the use can use the vise in the typical fashion.

An alternative embodiment of the present invention is shown as a vise 110 in FIG. 2. Vise jaw 110 includes a fixed jaw 12 and a moveable jaw 14, both supported on a base 22. The fixed and moveable jaws 12, 14 each include a working surface 116 each having a single horizontal slot 18A formed therein. The slot 18A removably receives a variety of inserts for supporting a workpiece.

The vise 110 operates in much the same way as the vise 10, described previously, with the exception of the working surface 116, which has a single slot 18A as opposed to the working surface 16, which has a series of spaced horizontal slots 18 formed therein. Preferably, the slots 18A are intermediately disposed horizontally along each working surface 116 and vertically co-planar to each other. Further, the slots 1 8A are preferably rectangular in cross-section and uniform along their respective lengths and widths, as shown in FIG. 8, but may also be formed of other cross-sectional shapes, such as elliptical as shown in FIGS. 2 and 3.

The slots 18A are adapted to receive the insert 20D, as shown in FIGS. 2 and 3. As discussed previously, the insert 20D is preferably a substantially L-shaped member with an anchoring finger 30 received within slot 18A and connected to a generally perpendicular supporting member 33 having a supporting surface 36 at its uppermost end. Alternatively, as discussed above, the insert may be a substantially T-shaped member, such as those shown in FIGS. 4 and 5 for vise 10. For this embodiment of the present invention, the supporting member 33 varies in height relative the anchoring finger 30 to define the height of the supporting surface 36. Thus, while providing only a single slot 18A in each working surface 116, the relative height of the supporting surface 36 for supporting the workpiece 50 is determined by selecting an insert 20D based on the height of its supporting member 33 relative its anchoring finger 30.

In use, vise 110 will be provided with several inserts 20D with supporting members having varying heights. For example, as illustrated in FIGS. 2 and 3, insert 20D includes a relatively short supporting member 33, while insert 20F, as illustrated in FIG. 8, includes a relatively long supporting member 33. Accordingly, when either anchoring finger 30 of each pair of inserts 20E–20F is inserted into opposing slots 18A in working surfaces 116 of the fixed and moveable jaws 12, 14, the relative height of the supporting surface 36 from the base 22 varies depending on the inserted insert 20E, 20F. While two different pairs of inserts are illustrated, between five and ten different-sized pairs of inserts are preferred, and more than ten pairs of inserts may be provided As shown in FIG. 8, as workpiece 50 has been inserted between the fixed jaw 12 and moveable 14 of the vise 110 according to the invention. An insert 20F is placed in the opposing slots 18A in order to support the workpiece 50 between the respective jaws 12, 14. As shown clamped, the jaws 12, 14 compress the workpiece 50 by exerting a horizontal force on each side of the workpiece 50 while the inserts 20F block the workpiece from movement in the downward direction, whereby the workpiece 50 is held at the selected height.

To select the height, the user of the vise 110 selects a pair of inserts, such as either pair 20E or 20F, for insertion into the opposed slots 18A of the working surfaces 116. Once selected and inserted, the workpiece 50 is supported on the supporting surfaces 36 of each insert 20F after the jaws 12, 14 have a place proximate enough to support the workpiece 50 without compressing the workpiece. Once the workpiece 50 is supported but not compressed, the moveable jaw 14 is moved toward the fixed jaw 12 until opposed horizontal pressures are exerted on the workpiece 50, at which point the workpiece 50 is held compressed at the selected height.

Similar to the vise 10, the vise 110 is also able to provide support for a workpiece 50 in a conventional manner by simply not inserting any of the inserts 20E, 20F. Then, by inserting the workpiece 50 with the base of the vise 110 blocking the workpiece against further downward movement, the moveable jaw 14 can be moved towards the fixed jaw 12 to clamp the workpiece 50 in place. Thus, the vise 110 also provides the operator with the additional ability to support a workpiece 50 at a desired height without eliminating the basic ability of the vise 110 to clamp a workpiece 50 in place consistent with conventional use.

As described above, the vise 10, 110 according to the invention includes the base 22 mounting the fixed jaw 12 and moveable jaw 14, each jaw having a working surface 16, 116. While the working surface 16, 116 can be formed integral with each jaw, as illustrated in FIG. 1*a*, the working surfaces 16, 116 may also be formed on attachments 60 for either replacing the conventional working surfaces of each jaw or placement over the conventional working surfaces of each jaw.

As shown in FIG. 1, the attachments 60 are removably fastened to the moveable jaw 12 and fixed jaw 14 of the vise 10 by a pair of screws 28 received through apertures 64 in attachments 60 and engaging threaded bores 62 in the jaws 12, 14. Many prior art vises include these threaded bores 62 for replacing worn out working surfaces on the jaws. Accordingly, the attachments 60 can replace those conventional vise jaw working surfaces, or can be fastened to the outer surface thereof.

While it will be apparent that the preferred embodiments of the invention disclosed are well calculated to fulfill the object stated, it should be appreciated that the invention is susceptible to modification, variation, and change without departing from the spirit thereof.

I claim:

1. A vise for holding a workpiece at various positions, comprising:

a body including a base, a first jaw having a first working surface and a second jaw having a second working surface wherein at least one of said jaws is movable with respect to the other jaw, said first and second working surfaces being disposed in a facing relation;

at least one slot formed vertically along each of said first and second working surfaces; and multiple pairs of inserts for assisting in securing a workpiece between said jaws, each pair of inserts having a supporting surface at a distance from said base and an anchoring finger for insertion into said at least one slot, a first insert of one of said multiple pairs of inserts disposed along said first surface through press-fit insertion of said anchoring finger of said first insert in one slot formed in said first surface, and a second insert of said multiple pairs of inserts disposed along said second working surface through press-fit insertion of said anchoring finger of said second insert in one slot formed in said second working surface, whereby upon selecting one of said multiple pairs of inserts and utilizing said first and second inserts, said working piece may be positioned on said supporting surface at a desired position relative said base.

2. The vise according to claim 1 wherein said at least one slot is elliptical in cross-section.

3. The vise according to claim 1 wherein said at least one slot in each of said first and second working surfaces is between two and ten slots.

4. The vise according to claim 1 wherein said first and second working surfaces are in the form of attachments fastened to said first and second jaws.

5. The vise according to claim 1 wherein said first working surface is integral with said first jaw and said second working surface is integral with said second jaw.

6. The vise according to claim 1 wherein said multiple pairs of inserts includes pairs of varying geometrical dimensions whereby selecting from different pairs of inserts, said workpiece can be positioned at various positions relative said base.

7. The vise according to claim 1 wherein said supporting surface for receiving said workpiece includes a wedge-shaped face.

8. The vise according to claim 1 wherein the anchoring finger includes a tapered leading edge to facilitate insertion into said slot.

9. The vise according to claim 8 wherein said pair of inserts are press fit into said slots.

10. The vise according to claim 1 wherein said at least one slot extends to an edge of said first and second working surfaces for attaching an insert.

11. A vice for holding a workpiece at various positions, comprising:

a body including a base, a first jaw having a first working surface and a second jaw having a second working surface wherein at least one of said jaws is movable with respect to the other jaw, said first and second working surfaces being disposed in a facing relation;

multiple pairs of opposed slots formed vertically spaced apart in said first and second working surfaces, each slot in said first working surface horizontally aligned with one slot in said second working surface;

a pair of inserts for assisting in securing a workpiece between said jaws, each pair of inserts having a supporting surface at a distance from said base, a first insert of said pair of inserts disposed in one of said slots formed in said first surface and a second insert of said pair of inserts disposed in one of said slots formed in said second working surface, said workpiece being positioned on said supporting surface at a desired position relative said base by selecting one of said multiple pairs of opposed slots and utilizing said first and second inserts.

12. The vise according to claim 11 wherein said multiple pairs of opposed slots are elliptical in cross-section.

13. The vise according to claim 11 wherein said multiple pairs of opposed slots in each of said first and second working surfaces is between two and ten slots.

14. The vise according to claim 11 wherein said first and second working surfaces are in the form of attachments fastened to said first and second jaws.

15. The vise according to claim 11 wherein said first working surface is integral with said first jaw and said second working surface is integral with said second jaw.

16. The vise according to claim 11 wherein said pair of inserts includes multiple pairs of inserts of varying geometrical dimensions whereby selecting from different pairs of inserts said workpiece can be positioned substantially along the entire length of the working surfaces.

17. The vise according to claim 11 wherein each insert includes a body for supporting said workpiece and an anchoring finger for insertion into said at least one slot.

18. The vise according to claim 17 wherein said body includes a wedge-shaped face for receiving said workpiece.

19. The vise according to claim 17 wherein the anchoring finger includes a tapered leading edge to facilitate insertion into said slot.

20. The vise according to claim 19 wherein said pair of inserts are press fit into said slots.

21. The vise according to claim 11 wherein said at least one slot extends to an edge of said first and second working surfaces for attaching an insert.

22. A vice for holding a workpiece, comprising:

a body including a base, a first jaw having a first working surface and a second jaw having a second working surface wherein at least one of said jaws is movable with respect to the other jaw, said first and second working surfaces being disposed in a facing relation;

multiple pairs of opposed slots formed vertically spaced apart in said first and second working surfaces, each slot in said first working surface horizontally aligned with one slot in said second working surface;

multiple pairs of inserts for assisting in securing a workpiece between said jaws, each pair of inserts having a supporting surface at a distance from said base, a first insert of one of said multiple pairs of inserts disposed in one slot formed in said first surface and a second insert of said multiple pairs of inserts disposed in one slot formed in said second working surface, whereby upon selecting one of said multiple pairs of inserts and utilizing said first and second inserts, said working piece may be positioned on said supporting surface at a desired position relative said base;

each insert includes a supporting surface for receiving said workpiece and an anchoring finger for insertion into said at least one slot; and wherein the anchoring finger includes a tapered leading edge to facilitate insertion into said slot.

* * * * *